US005551167A

United States Patent [19]

van Fossen

[11] Patent Number: 5,551,167

[45] Date of Patent: Sep. 3, 1996

[54] CONTINUOUS-FLOW GRAIN STEEPING AND COOLING METHOD AND APPARATUS

[75] Inventor: Larry van Fossen, Ames, Iowa

[73] Assignee: Iowa State University Research Foundation, Inc., Ames, Iowa

[21] Appl. No.: 269,736

[22] Filed: Jul. 1, 1994

[51] Int. Cl.[6] ..... F26B 3/00; F26B 19/00

[52] U.S. Cl. ..... 34/491; 34/492; 34/497; 34/429; 34/554; 34/168

[58] Field of Search ..... 34/391, 395, 429, 34/554, 560, 210, 218, 170, 171, 491, 492, 497, 168

[56] References Cited

U.S. PATENT DOCUMENTS

| | | | |
|---|---|---|---|
| 2,858,620 | 11/1958 | Naylor | 34/575 |
| 3,559,299 | 2/1971 | Tyler | 34/218 X |
| 3,701,203 | 10/1972 | Anderson | 34/391 X |
| 4,004,351 | 1/1977 | Sanngman et al. | 34/560 |
| 4,050,163 | 9/1977 | Short | 34/210 X |
| 4,118,875 | 10/1978 | Sietmann et al. . | |
| 4,125,945 | 11/1978 | Westelaken | 34/171 X |
| 4,217,701 | 8/1980 | Mathews . | |
| 4,424,634 | 1/1984 | Westelaken . | |
| 4,750,273 | 6/1988 | Parkes et al. | 34/560 X |
| 5,020,246 | 6/1991 | Rust et al. . | |
| 9,126,946 | 11/1978 | Buffington et al. | 34/395 |

*Primary Examiner*—Hoang Nguyen
*Attorney, Agent, or Firm*—Henderson & Sturm

[57] ABSTRACT

A continuous-flow grain steeping and slow grain cooling process and apparatus. The continuous charging of hot, partially dried grain from a heated-air dryer into the top of a grain container in a layer of approximately uniform thickness is accomplished by use of grain spreading equipment. The downward flow of grain through the grain container is regulated by thermostatically controlled sweep and discharge augers located in the bottom of the bin. The grain flows at a rate that allows the grain to remain in a top steeping zone for a predetermined period of time, typically from four to twelve hours. After the initially charged grain is held at the steeping temperature for a predetermined steeping time, a continuous upward flow of ambient air is provided by a fan to cool the grain in a bottom cooling zone. The air flow is controlled by a thermostat to provide air flow at a rate that allows grain to remain in the cooling zone for a predetermined cooling time which is dependent on the airflow rate in cfm/bu. Cooled dry grain from a layer near the bottom is then continuously discharged from the bottom of the grain container by the sweep and discharge augers.

20 Claims, 2 Drawing Sheets

CONTINUOUS-FLOW GRAIN STEEPING AND COOLING METHOD AND APPARATUS

TECHNICAL FIELD

This invention relates to a method of conditioning grain, and more particularly to a process for steeping and slowly cooling grain partially dried in a heated-air grain dryer, and apparatus used to practice the process.

BACKGROUND ART

Slow grain cooling is a proven, widely adopted and effective technique to cool grain that has been dried in a heated-air grain dryer. Steeping (short-term storage without aeration) and slowly cooling hot, dried grain will efficiently remove an additional one to four points of moisture. There are three recognized main advantages of slowly cooling grain that has been dried in a heated-air grain dryer: increased drying capacity, reduced operating costs for drying, and improved grain quality.

Specific known processes utilizing slow grain cooling include in-bin cooling, combination high-temperature/low temperature drying and dryeration. Of these processes, dryeration has the greatest potential for rapidly and efficiently reducing moisture content in grain.

In the dryeration process, hot, dried grain is discharged from a heated-air grain dryer into a grain bin, tank or other grain container where two separate grain conditioning subprocesses occur. The hot grain is first steeped at its removal temperature from the grain dryer for a predetermined period of time. The removal temperature is the temperature at which the grain is discharged from the heated-air dryer, typically 140° F. to 160° F. During this steeping time, usually from four to twelve hours, temperature and moisture tend to become uniform within each kernel and between kernels. Following steeping, the grain is cooled by moving ambient air through it. This dryeration process (steeping and then cooling by aeration) has been commonly found to remove up to four additional points of moisture from the grain after the grain leaves the heated-air grain dryer, in addition to the points of moisture removed in the dryer.

The amount of moisture removed by the grain steeping and cooling process is dependent upon the difference between the grain temperature entering and the grain temperature leaving the process, and the time the grain is steeped. Although not well verified by research, considerable experience indicates adequately steeping grain will cause it to lose 0.20 to 0.25 percentage points of moisture for each 10° F. temperature reduction during cooling. The temperature at which the grain leaves the dryer and enters the steeping process is dependent upon the drying air temperature and the efficiency of the heated air grain dryer. Common grain temperatures of grain leaving a dryer operating between 180° F. and 200° F. is 140° F. to 160° F., but both higher and lower dryer operating temperatures, and therefore grain temperatures, are also common. The grain temperature will remain at this temperature during steeping and until the grain enters the cooling process, when it is cooled by aeration with ambient air. The temperature of the grain leaving the cooling process is a few degrees below the ambient air temperature. Although an ambient temperature range of 50° F. to 60° F. is common during the fall, both higher and lower temperatures are frequently encountered. Following are two examples of approximate low and high expected moisture reductions during the grain steeping and cooling process:

low, [(100° F.−70° F.)+10° F.]×0.20 points=0.60 points high, [200° F.−20° F.)+10° F.]×0.25 points=4.50 points One problem with the dryeration process as currently employed is that it is normally practiced as a batch process requiring two grain bins or tanks (one for steeping and one for cooling) and the associated handling equipment. Thus, a substantial capital investment is required.

Those concerned with these and other problems recognize the need for an improved grain steeping and cooling process method and apparatus.

DISCLOSURE OF THE INVENTION

The present invention provides a continuous-flow grain steeping and slow cooling process and apparatus. The process includes the charging of hot, partially dried grain from a heated-air grain dryer into the top of a grain container in a layer of approximately uniform thickness is accomplished by use of grain spreading equipment. The downward flow of grain through the grain container is regulated by thermostatically controlled sweep and discharge auger or augers located in the bottom of the bin. The grain flows down and out of the container at a rate that allows the grain to remain in a top steeping zone for a predetermined period of time, typically from four to twelve hours. After the initially charged grain is held at the steeping temperature for a predetermined steeping time, a continuous upward flow of ambient air is provided by a fan to cool the grain in a bottom cooling zone. The fan is controlled by a thermostat to provide air flow at a rate that allows grain to remain in the cooling zone for a predetermined cooling time which is dependent on the airflow rate in cfm/bu (cubic feet of air per minute per bushel). Above the cooling zone, air heated to the hot grain temperature flows up through the steeping grain without affecting the steeping process. Cooled dry grain from a layer near the bottom is then discharged from the bottom of the grain container by the sweep auger or augers and the discharge auger.

An object of the present invention is the provision of an improved slow grain steeping and cooling method and apparatus.

Another object is to provide a continuous-flow slow grain cooling process that may be practiced in a single grain container.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
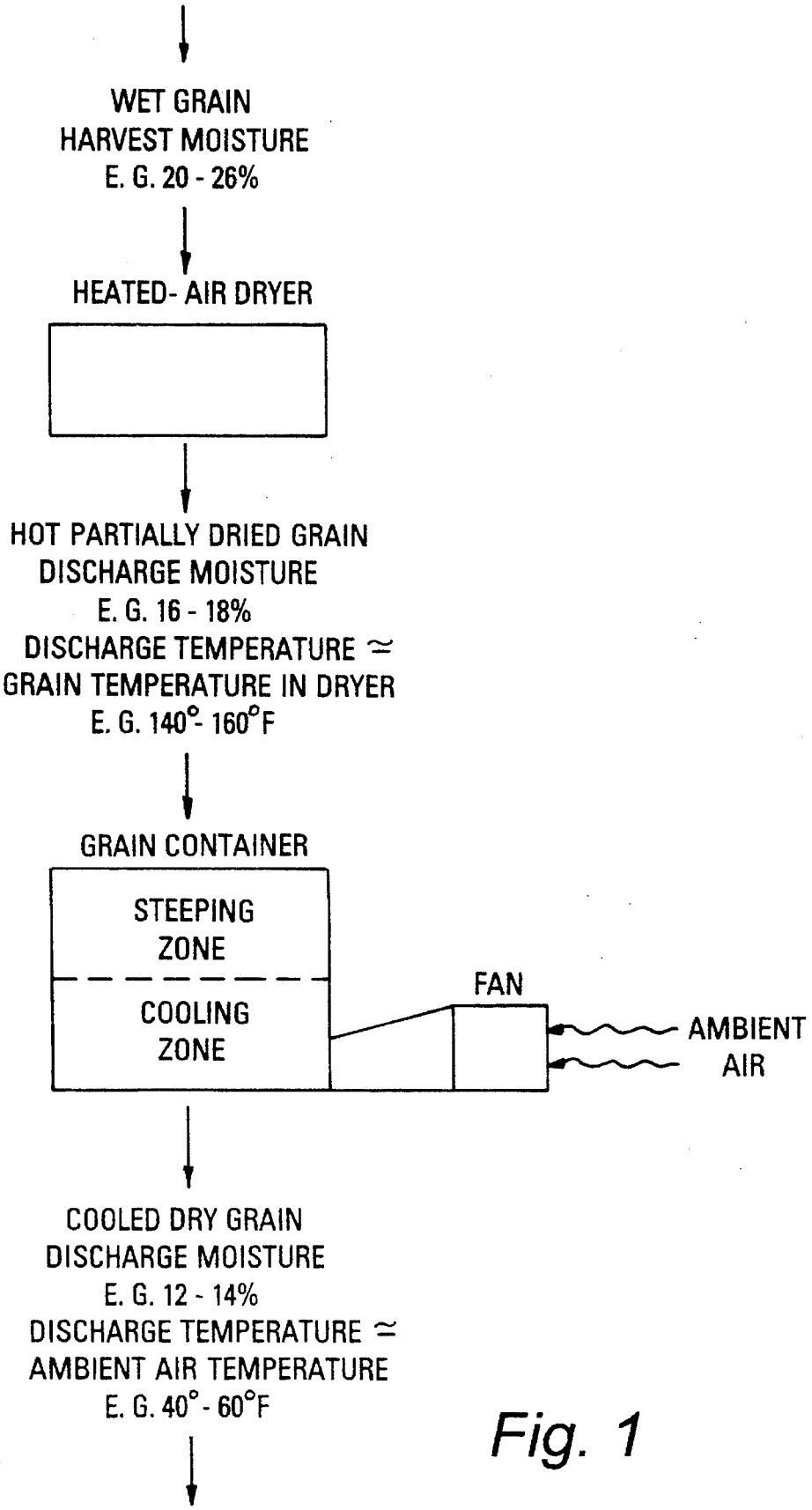
FIG. 1 is a schematic drawing illustrating the flow of grain conditioned by the method of the present invention.

Referring now to the drawings, FIG. 1 illustrates the flow of the grain from harvest as wet grain, through heated-air grain drying, through the continuous-flow grain container, to longer term storage or transported as cool dried grain.

Continuous-flow grain steeping and cooling systems utilize existing or modified equipment commonly used for continuous-flow in-bin grain drying or newly developed equipment in an existing grain bin, grain tank, self-contained column grain dryer, silo, remodeled or converted corn crib, grain wagon, etc. adapted to incorporate continuous grain flow capability. In the process of the present invention, grain flows into the container at or near the top and is discharged at or near the bottom.

The process is a continuous process that combines grain steeping and grain cooling. The grain container is equipped with continuous-flow grain handling equipment and airflow equipment. Appropriate controls regulate both the flow of grain through the grain container after a predetermined and adequate steeping time and also the discharge of cooled grain from the grain container.

In operation, newly harvested wet grain commonly having a moisture content of approximately 20–26% is transferred from the harvesting equipment to a heated-air grain dryer. The heated-air dryer commonly reduces the grain moisture content to a level of about 16–18% and the partially dried grain is discharged from the dryer without being cooled, e.g. generally, at a temperature of about 140°–160° F. This hot, partially dried grain is then continuously charged into the grain container through an opening at or near the top.

During the start-up phase, hot partially dried grain is laid into the grain container in a layer of approximately uniform thickness by use of a conventional grain spreader or other suitable devices. When the first grain charged into the grain container has achieved a predetermined residence time, typically from four to twelve hours, which can be controlled manually or with an appropriate timing device, a continuous flow of ambient air is directed upwardly through the grain to begin the cooling process. A cooling front travels upwardly through the grain mass while hot and partially dried grain is added to increase the depth of the grain mass. The grain mass is divided into an upper steeping zone and a lower cooling zone as the grain container is filled to a predetermined capacity to complete the start-up phase.

After the initial start up, hot partially dried grain is charged into the top of the grain container in a layer of approximately uniform thickness. The continuous downward flow of grain is regulated at a rate that allows the grain to remain in the steeping zone for a predetermined period of time, typically from four to twelve hours. The upward flow of ambient air through the grain mass is provided at a rate that allows the grain to remain in the cooling zone for a predetermined cooling time as determined by the fan airflow rate in cfm/bu. The upward flow of ambient air is interrupted so that the cooling zone does not enter the grain before it has been adequately steeped. Cooled dry grain having a temperature slightly lower than ambient air and a moisture content of about 12–14% is discharged from an approximately uniform thickness layer of grain at the bottom of the container by a bottom mounted sweep auger or augers or other suitable equipment.

One variation of the present invention is the utilization of the continuous-flow principle to remove hot adequately steeped grain from the grain conditioning container prior to cooling. The hot, steeped grain can be cooled in a storage container, such as a grain bin equipped with a properly sized fan and air distribution system, such as a perforated floor or duct system. This cooling process will remove approximately the same amount of moisture as the previously described process. One caution with cooling hot, steeped grain in a storage bin is the possibility of excessive water condensation on the sidewalls. This water can run down into the grain and cause serious grain deterioration and storage problems.

EXAMPLE

Figure 2:
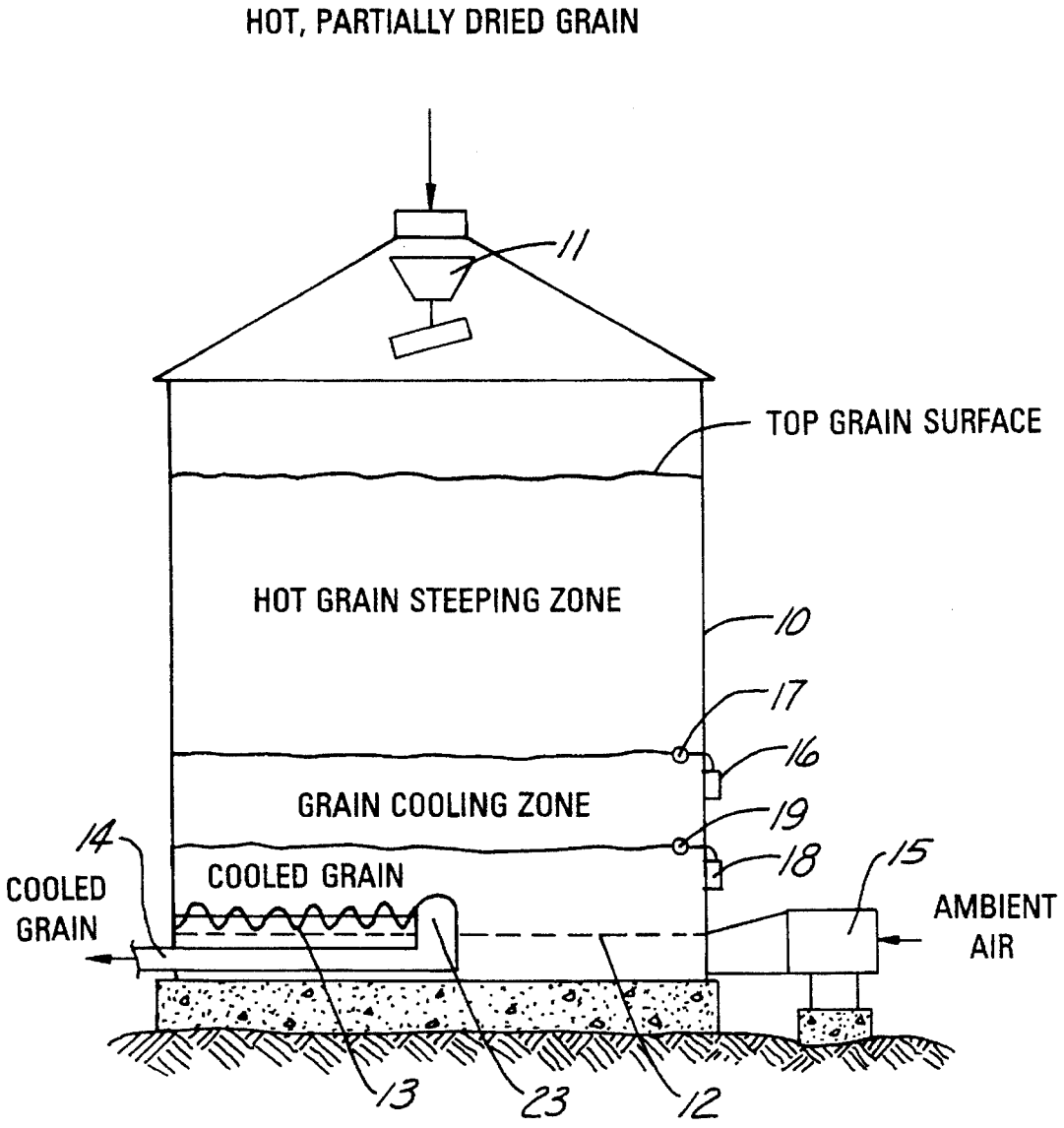
FIG. 2 is a cross-sectional view of a grain bin used to practice the grain steeping and cooling method.

This Example describes the grain flow and air flow through a bin, the equipment needed and the function of the controls to control the equipment to develop a continuous-flow grain steeping and cooling process in a conventional cylindrical grain storage bin (10) as shown in FIG. 2.

There are several manufacturers for most of the equipment listed. The grain spreading equipment (11) maintains the grain surface in the bin (10) in a layer of relatively uniform thickness and as level as possible. The grain spreading capacity must be equal to or exceed the maximum grain drying and/or partially dried grain unloading capacity of the heated-air grain dryer. A full perforated floor (12) is installed in the bin (10). There must be adequate plenum space between the concrete floor and perforated floor (12) to permit unrestricted air flow under the perforated floor (12) and for the installation of the continuous-flow grain handling equipment power mechanism (23) and discharge auger (14). The perforated floor (12) has sufficient area of openings to permit nearly unrestricted ambient air flow through the floor (12) into and through the grain to be steeped and cooled.

The continuous-flow equipment includes one or more sweep augers (13) that rotate around the continuous-flow equipment power mechanism (23) located at the center of the perforated floor (12). The sweep auger or augers uniformly remove a shallow layer of grain of relatively uniform thickness from the perforated floor (12) and convey it to the center mechanism where it flows by gravity into the discharge auger (14) located under the perforated floor (12). The discharge auger (14) unloads the cool, dried grain from the bin (10). There are several known manufacturers of continuous-flow in-bin grain drying equipment that are designed to be installed and used in cylindrical grain bins for grain drying. This equipment could be adapted for continuous-flow grain steeping and cooling. The equipment that is presently manufactured should be evaluated to determine if it could be redesigned to reduce its costs and still satisfactorily handle grain that will be only steeped and cooled rather than dried.

The fan (15) moves an adequate ambient air flow through the hot, steeped grain to cool it. The grain cooling capacity should exceed the maximum grain drying capacity of the heated-air grain dryer. The fan must be capable of moving the required volume of air against the resistance the full bin of grain will create.

The remote bulb fan thermostat (16) is equipped with contacts to close and start the fan (15) when the remote bulb (17) senses that the temperature rises to the selected temperature setting. The selected temperature setting should be a few degrees lower than the hot grain temperature. The thermostat (16) should have a variable temperature differential, which is the temperature drop necessary before the contacts will open and stop the fan (15). The remote temperature sensing bulb (17) should be located in the grain at a level in the bin (10) which will maintain an adequate volume of grain for proper steeping.

The continuous-flow remote bulb thermostat (18) has contacts that open to stop the continuous-flow equipment when the remote bulb (19) senses a temperature rise. The selected temperature setting should be a few degrees above the ambient air temperature. The temperature differential should be approximately 2° F. for the temperature to drop and close the contacts to start the continuous-flow equipment. The remote temperature sensing bulb (19) should be located in the grain at the lowest level in the bin (10) to maintain the desired volume of cooled grain. A single pole switch (not shown) will be wired in parallel to the thermostat (18) to manually control the continuous-flow equipment for use when it is necessary to empty grain from the bin (10).

The two thermostats (16 and 18) provide control for the continuous-flow grain steeping and cooling process. The fan thermostat (16) is essential. Its remote sensing bulb (17) is located at the bottom of the hot grain steeping zone, which is also the top of the grain cooling zone. The hot grain steeping zone must have adequate depth to allow the grain to be steeped at least 4 hours. The temperature setting for the fan thermostat (16) should be a few degrees lower than the temperature of the hot, dried grain. The fan thermostat (16) should be wired to control fan operation. Its function is to limit the distance the grain cooling zone can move up into the hot grain steeping zone. If the fan (15) is not operating and the lower edge of the hot grain steeping zone reaches the remote bulb (17), the higher temperature of the hot corn will be sensed, and the contacts will close and start the fan (15). When the cooling air cools the grain and the remote bulb (17) to the setting on the variable differential thermostat (16), the contacts will open and stop the fan (15).

The continuous-flow thermostat (18) is needed to maintain a minimum depth of cooled grain in the bin (10) by stopping the continuous-flow equipment and thus preventing hot grain that has excessive moisture from being removed from the bin (10) in case an emergency develops. An emergency might be due to uneven grain removal by the continuous-flow equipment or failure of the fan (15) to operate correctly. The remote bulb (19) is located at the lowest level in the bin (10) to maintain an adequate amount of cooled grain. The temperature setting should be a few degrees above the ambient air temperature.

The heights of the fan thermostat (16) and continuous-flow thermostat (18) may be selected to hold or store an adequate capacity of cooled grain in the bottom of the bin (10) until a conveyor is available to remove the cooled grain. Increased storage volume in the cooled grain zone serves as grain holding for the conveyor.

These two thermostats (16 and 18) are the simplest control system to control the fan (15) and continuous-flow grain handling equipment. More elaborate control systems can be developed to adapt grain steeping and cooling bins for additional functions. For example, an overriding control could be included in the circuit that would not permit cooled grain to be unloaded if the conveyor it discharges into is being used for another grain conveying function. In addition, the moisture grain content can be monitored with appropriate grain moisture testing equipment. This equipment and the electrical wiring circuits within the equipment can be designed to select one of two discharge conveyors. One discharge conveyor would move grain that has been adequately dried to storage or to be transported as dried grain. The other discharge conveyor would move grain that is not adequately dried to the wet grain holding bin or tank or to the dryer.

The flow of hot, dried grain from the dryer to and through the continuous-flow grain steeping and cooling bin (10) follows these steps:

1. The partially dried grain is removed from the heated-air batch or continuous-flow grain dryer without being cooled and at a moisture content of about 2 to 4 points higher than the desired moisture content for storage. When the hot grain is removed from the dryer, its temperature is dependent on the drying air temperature in the grain dryer.

2. The hot grain is conveyed continuously or in batches to the continuous-flow steeping and cooling bin (10) where it flows through the grain spreader (11) which maintains a grain surface that is approximately level.

3. Cooled grain is discharged intermittently by continuous-flow equipment from the bottom of the bin (10) at an average conveying rate equal to or slightly higher than the rate the hot, dried grain is loaded into the bin.

4. The hot grain moves by gravity through the hot grain steeping zone to replace the cooled grain that is removed from the bottom of the bin (10). The grain remains in the steeping zone for at least about four hours to permit the grain temperature and moisture content to become uniform within each kernel and between kernels.

5. As the hot, steeped grain reaches and moves by gravity through the grain cooling zone, ambient air is forced through the hot grain to cool it. The grain is cooled to within 1° to 2° F. of the ambient air temperature. Cooling removes up to about four points of moisture from the grain. The amount of moisture removed from the grain during cooling is directly related to the temperature the grain drops during cooling and the time the grain is steeped.

6. After the grain is cooled and dried to the desired moisture content, it continues to fall by gravity to the perforated floor (12). A layer of grain of relatively uniform thickness is conveyed on the perforated floor (12) by the continuous-flow sweep auger or augers (13) to the center of the continuous-flow mechanism (23) in the center of the perforated floor (12). At that location, the grain flows by gravity into the discharge auger (14) that conveys it out of the bin (10).

The movement of air into and through the grain causes temperature and moisture changes in the grain and air. Ambient air is forced by the fan (15) into the plenum under the floor (12) and up through the perforated floor (12) where it enters and passes through the grain. The fan (15) will increase air temperature up to 2° F. above the ambient temperature depending on the efficiency of the fan (15) and fan motor. The air passes through the cooled grain with no significant temperature change. As the air enters warmer grain in the grain cooling zone, it will cool the grain to within about 2° F. of the ambient air temperature and remove up to about four points of moisture from the grain. When the air reaches the top of the cooling zone, which is also the bottom of the hot grain steeping zone, the air will have a very high relative humidity and the air temperature will be the same as the grain temperature in the hot grain steeping zone.

Thus, it can be seen that at least all of the stated objectives have been achieved.

Obviously, many modifications and variations of the present invention are possible in light of the above teachings. It is therefore to be understood that, within the scope of the appended claims, the invention may be practiced otherwise than as specifically described.

I claim:

1. A continuous-flow grain conditioning process for a grain container having a top and a bottom, grain in the grain container being held first in a top steeping zone and then a bottom cooling zone, the process comprising the steps of:

heating harvested grain in a grain dryer to produce hot, partially dried grain;

distributing the hot, partially dried grain into the top of the grain container in an approximately level and uniformly thick layer;

providing a downward flow of the grain through the grain container;

sensing a cooled grain temperature in a lower portion of the cooling zone;

controlling the downward flow of grain based on the cooled grain temperature, the downward grain flow being at a rate that allows the grain to remain in the top steeping zone for a predetermined steeping time;

providing an upward flow of ambient air through the grain container such that the ambient air passes through the grain in the cooling zone and the grain in the steeping zone;

wherein the ambient air first passes through the grain in the cooling zone and is heated by the grain to the grain temperature at the top of the cooling zone, which is also the bottom of the steeping zone, and then passes through the grain in the steeping zone;

sensing a hot grain temperature in a lower portion of the steeping zone;

controlling the upward flow of ambient air based on the hot grain temperature in the bottom cooling zone, the upward flow of ambient air being at a rate that allows the grain to remain in the bottom cooling zone until it is cooled to a temperature within a few degrees of the ambient air temperature, whereby the combination of steeping and cooling the grain will cause about four additional points of moisture to be removed from the grain; and discharging cooled dry grain from a layer of approximately uniform thickness near the bottom of the grain container.

2. The process of claim 1 wherein the hot partially dried grain has a temperature of about 140°–160° F. and a moisture content of about 16–18 percent.

3. The process of claim 1 wherein the predetermined steeping time is from about four hours to about twelve hours.

4. The process of claim 1 wherein grain is cooled to about the ambient air temperature.

5. The process of claim 1 wherein the cooled dry grain has temperature of about the ambient air temperature and a moisture content of about 12–14 percent.

6. A continuous-flow grain conditioning apparatus for a grain container having a top and a bottom, grain in the grain container being held first in a top steeping zone and then a bottom cooling zone, the apparatus comprising:

means separate from the grain container for heating harvested grain to produce hot, partially dried grain;

means for distributing the hot, partially dried grain into the top of the grain container in an approximately level and uniformly thick layer;

means for providing a downward flow of the grain through the grain container;

means for sensing a cooled grain temperature in a lower portion of the cooling zone;

means for controlling the downward flow of grain based on the cooled grain temperature, the downward grain flow being at a rate that allows the grain to remain in the top steeping zone for a predetermined steeping time;

means for providing an upward flow of ambient air through the grain container wherein the ambient air passes through the grain in the cooling zone and the grain in the steeping zone;

means for sensing a hot grain temperature in a lower portion of the steeping zone;

means for controlling the upward flow of ambient air based on the hot grain temperature in the bottom of the hot grain steeping zone, which is also the top of the cooling zone, the upward flow of ambient air being at a rate that allows the grain to remain in the bottom cooling zone until it is cooled to a temperature within a few degrees of the ambient air temperature, whereby the combination of steeping and cooling the grain will cause about four additional points of moisture to be removed from the grain; and means for discharging cooled dry grain from a layer of approximately uniform thickness near the bottom of the grain container.

7. The apparatus of claim 6 wherein the hot partially dried grain has a temperature of about 140°–160° F. and a moisture content of about 16–18 percent.

8. The apparatus of claim 6 wherein the predetermined steeping time is from about four hours to about twelve hours.

9. The apparatus of claim 6 wherein grain is cooled to about the ambient air temperature.

10. The apparatus of claim 6 wherein the cooled dry grain has a temperature of about the ambient air temperature and a moisture content of about 12–14 percent.

11. The apparatus of claim 10 wherein the cooled dry grain is monitored and conveyed to dry grain storage or transported as dried grain if it has been adequately dried or conveyed to a wet grain bin or tank if it is not adequately dried.

12. The apparatus of claim 6 wherein the distributing means includes a grain spreader mounted at the top of the grain container.

13. The apparatus of claim 6 wherein the downward grain flow control means includes a sweep auger and a discharge auger operably mounted at the bottom of the grain container.

14. The apparatus of claim 13 wherein the cooled grain temperature sensing means includes a remote cool sensing bulb disposed in the grain container in the lower portion of the grain cooling zone.

15. The apparatus of claim 14 wherein the downward grain flow control means includes a thermostat operably interconnecting the remote cool sensing bulb and the sweep and discharge augers.

16. The apparatus of claim 6 wherein the upward air flow means includes a perforated floor mounted in the bottom of the grain container and a fan operably connected the grain container below the perforated floor.

17. The apparatus of claim 16 wherein the hot grain temperature sensing means includes a remote hot sensing bulb disposed in the grain container in the upper portion of the grain cooling zone, which is also the lower portion of the grain steeping zone.

18. The apparatus of claim 17 wherein the upward air flow control means includes a thermostat operably interconnecting the remote hot sensing bulb and the fan.

19. The apparatus of claim 6 wherein the cooled grain discharge means includes a sweep auger or augers operably mounted at the bottom of the grain container.

20. The apparatus of claim 18 wherein the cooled grain discharge means includes a sweep auger or augers operably mounted at the bottom of the grain container immediately above the perforated floor.

* * * * *

UNITED STATES PATENT AND TRADEMARK OFFICE

CERTIFICATE OF CORRECTION

PATENT NO. : 5,551,167
DATED : September 3, 1996
INVENTOR(S) : Larry Van Fossen

It is certified that error appears in the above-indentified patent and that said Letters Patent is hereby corrected as shown below:

Title page, items [19] and [75], inventor: correct the inventor's name by deleting "van" and inserting--Van--.

In the Specification at column 2, in the first equation (line 1), delete "low, [(100°F. - 70°F.) + 10°F.] x 0.20 points = 0.60 points" and insert --low, [(100°F. - 70°F.) ÷ 10°F.] x 0.20 points = 0.60 points--.

In the Specification at column 2, in the second equation (line 2), delete "high, [200°F. - 20°F.) + 10°F.] x 0.25 points = 4.50 points" and insert --high, [200°F. - 20°F.) ÷ 10°F.] x 0.25 points = 4.50 points--.

Signed and Sealed this

Eleventh Day of March, 1997

*Attest:*

*Attesting Officer*

BRUCE LEHMAN

*Commissioner of Patents and Trademarks*